US005158193A

United States Patent [19]

Chen

[11] Patent Number: 5,158,193

[45] Date of Patent: Oct. 27, 1992

[54] ANTI-SLIP STRUCTURE FOR CUPS

[76] Inventor: Tzung-Wen Chen, No. 13, Yen-Ping St., Tainan, Taiwan

[21] Appl. No.: 743,980

[22] Filed: Aug. 12, 1991

[51] Int. Cl.[5] ..... A47G 19/22; B65D 25/24

[52] U.S. Cl. ..... 215/100 R; 220/632; 220/729; 229/1.5 B; 248/346.1; 248/359.1

[58] Field of Search ..... 215/100 R, 1 C; 248/359.1, 346.1; 220/632, 729; 229/1.5 B

[56] References Cited

U.S. PATENT DOCUMENTS

| | | | |
|---|---|---|---|
| 48,996 | 7/1865 | Percival | 215/100 R |
| 100,374 | 3/1870 | Carleton | 220/632 |
| 282,244 | 7/1883 | Vernon | 220/632 |
| 461,097 | 10/1891 | Llewellyn et al. | 220/632 |
| 596,194 | 12/1897 | Wales et al. | 215/100 R |
| 2,018,271 | 10/1935 | Lewis | 220/632 |
| 2,142,283 | 1/1939 | Ohme | 220/632 X |
| 2,548,035 | 4/1951 | May | 220/632 |
| 2,750,769 | 6/1956 | Yost et al. | 220/632 |
| 2,905,351 | 9/1959 | Lerner | 215/100 R |
| 4,767,015 | 8/1988 | Ho | 220/632 X |

FOREIGN PATENT DOCUMENTS

| | | | |
|---|---|---|---|
| 1156697 | 10/1963 | Fed. Rep. of Germany | 220/632 |
| 1254299 | 1/1961 | France | 220/632 |
| 5515 | of 1887 | United Kingdom | 220/632 |
| 201689 | 8/1923 | United Kingdom | 220/632 |
| 693121 | 6/1953 | United Kingdom | 215/100 R |

*Primary Examiner*—Sue A. Weaver

[57] ABSTRACT

An anti-slip structure for cups comprising an annular groove in the cup bottom wall, an outer annular anti-slip band made of an elastic material and an inner fixing ring fixed together securely in said annular groove so as to make said outer anti-slip band extend a little down beyond the cup bottom surface.

1 Claim, 6 Drawing Sheets

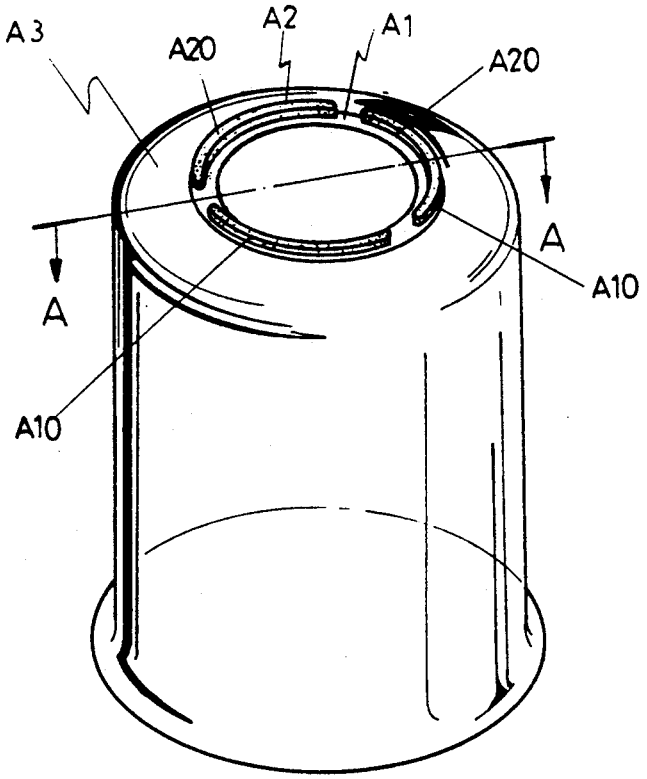
Fig 1 (PRIOR ART)
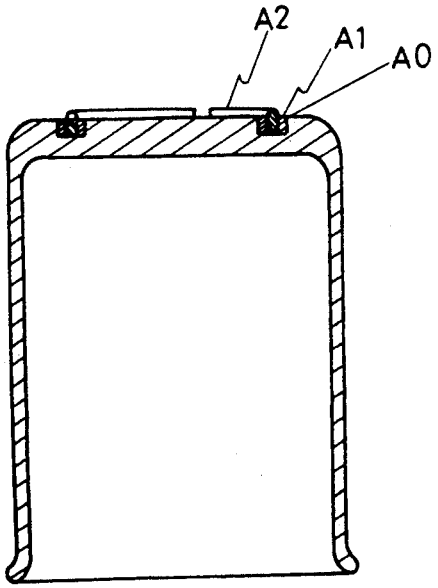
Fig 2 (A-A) (PRIOR ART)

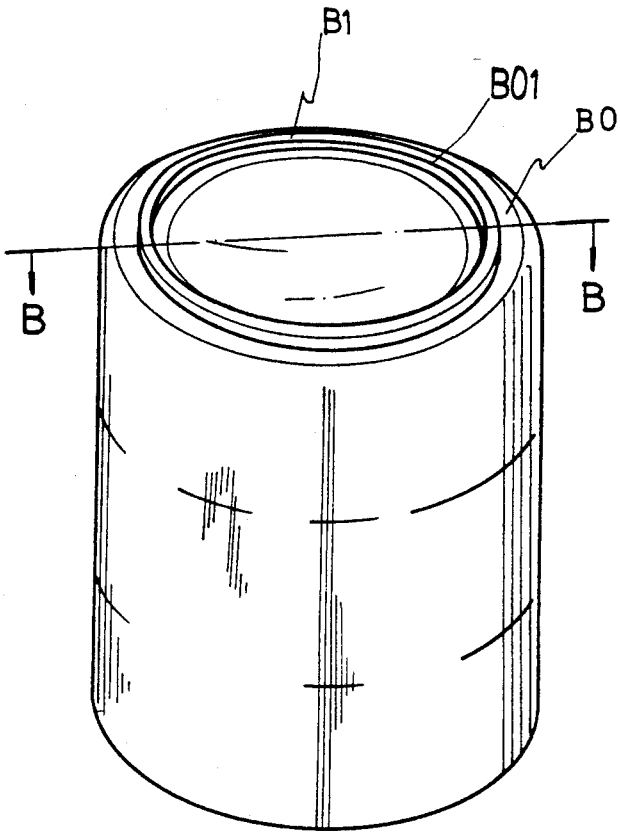
Fig 3 (PRIOR ART)
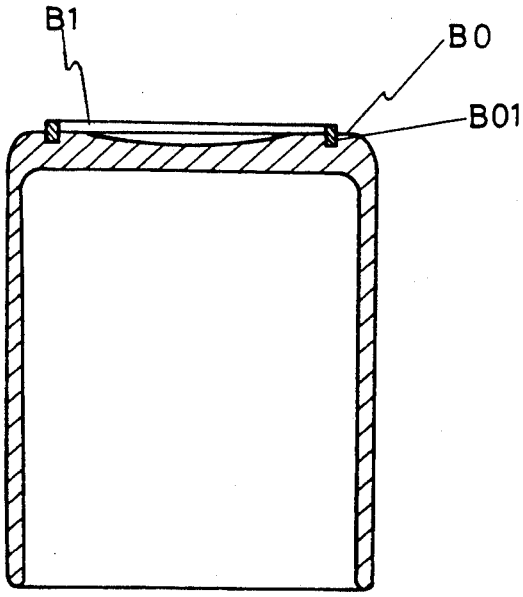
Fig 4 (B-B) (PRIOR ART)

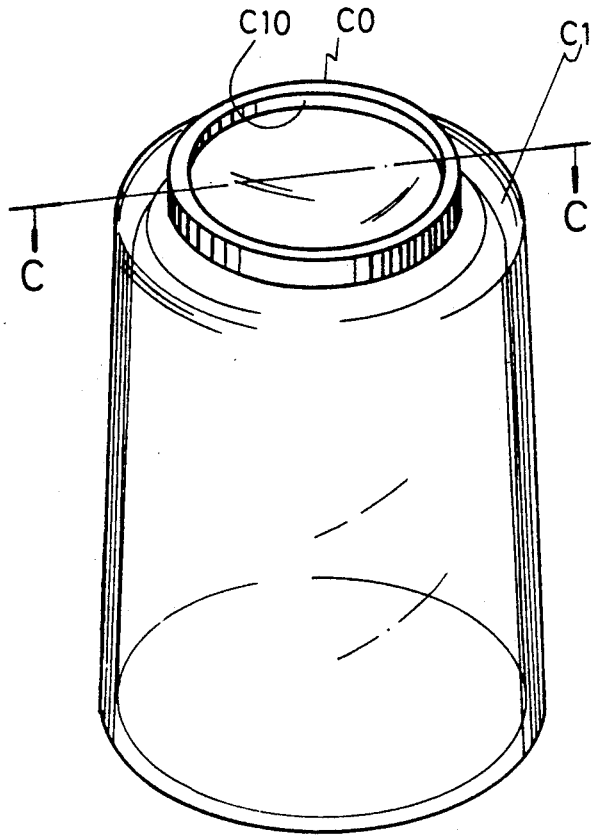
Fig 5 (PRIOR ART)
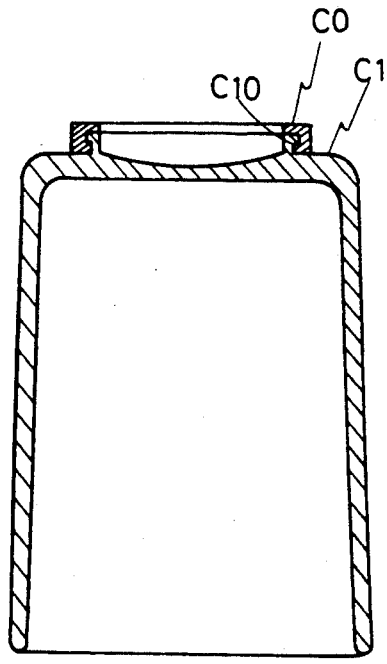
Fig 6 (C-C) (PRIOR ART)

ANTI-SLIP STRUCTURE FOR CUPS

BACKGROUND OF THE INVENTION

Some anti-slip cups on market a present are shown in FIGS. 1–6. The first kind of them shown in FIGS. 1 and 2 has an annular groove A0 in the bottom wall A3 for an annular washer A1 made of hard plastic to fit securely in. The annular washer A1 is provided with three curved grooves A10 for three curved ribs A20 to fit in and extend out of the bottom wall so that the three curved ribs A2 forming an anti-slip ring A2 can prevent a cup from slipping. But the disadvantage of this kind is that combining the annular washer A1 with the cup bottom wall should be performed by a supersonic processing machine, which increases its cost.

The second kind shown in FIGS. 3 and 4 has an annular groove B01 in the cup bottom wall B0 for an annular anti-slip band B1 to fit in and extend out of the bottom wall Bo. Its disadvantage is that the annular anti-slip band B1 is liable to fall off the cup.

The third kind shown in FIGS. 5 and 6 has a projection disc C10 on the cup bottom wall C1, and an annular anti-slip band C0 made of PVC having an inner annular recess fit around the disc C10. Its disadvantage is that the anti-slip band is too high, making the cup insecure because of the high center of gravity of the cup.

SUMMARY OF THE INVENTION

In order to equip a cup with an anti-slip function which can be attained by a simple anti-slip structure, this invention has been devised.

The anti-slip structure for cups in accordance with the present invention comprises an annular groove of L-shape cross-section in the cup bottom wall, an outer anti-slip annular band of reverse and inverted L-shaped cross-section and an inner fixing ring of L-shaped cross-section. Both the outer anti-slip band and the inner fixing ring are together fitted in the annular groove in the cup bottom wall, and kept securely therein with the elasticity of the material which the outer anti-slip band is made of.

BRIEF DESCRIPTION OF THE DRAWINGS

FIG. 1 is a perspective view of the first kind of conventional anti-slip cup.

FIG. 2 is a cross-sectional view of the first kind of conventional anti-slip cup.

FIG. 3 is a perspective view of the second kind of conventional anti-slip cup.

FIG. 4 is a cross-sectional view of the second kind of conventional anti-slip cup.

FIG. 5 is a perspective view of the third kind of conventional anti-slip cup.

FIG. 6 is a cross-sectional view of the third kind of conventional anti-slip cup.

DETAILED DESCRIPTION OF THE INVENTION

Figure 7:
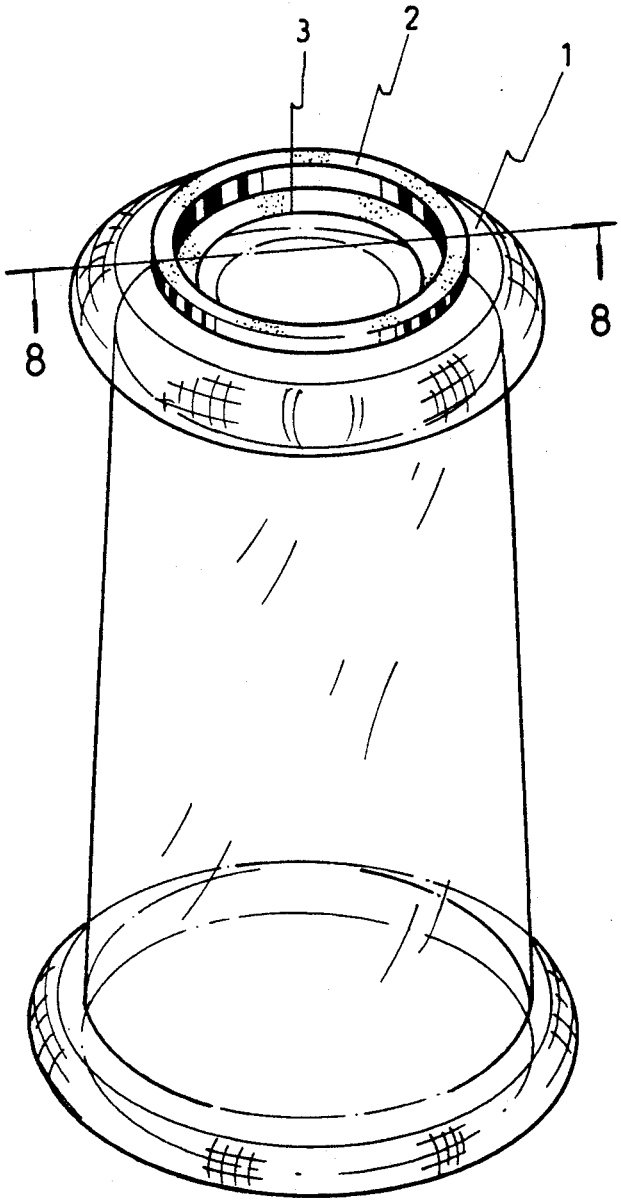
FIG. 7 is a perspective view of a cup with the anti-slip structure in accordance with the present invention.
Figure 8:
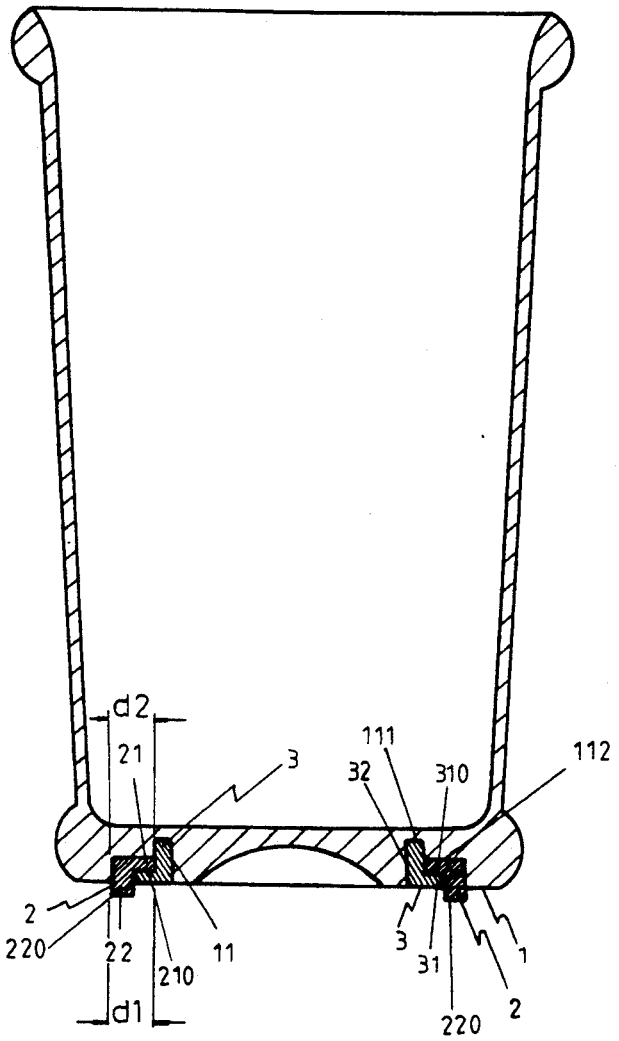
FIG. 8 is a cross-sectional view of line 8—8 in FIG. 7.
Figure 9:
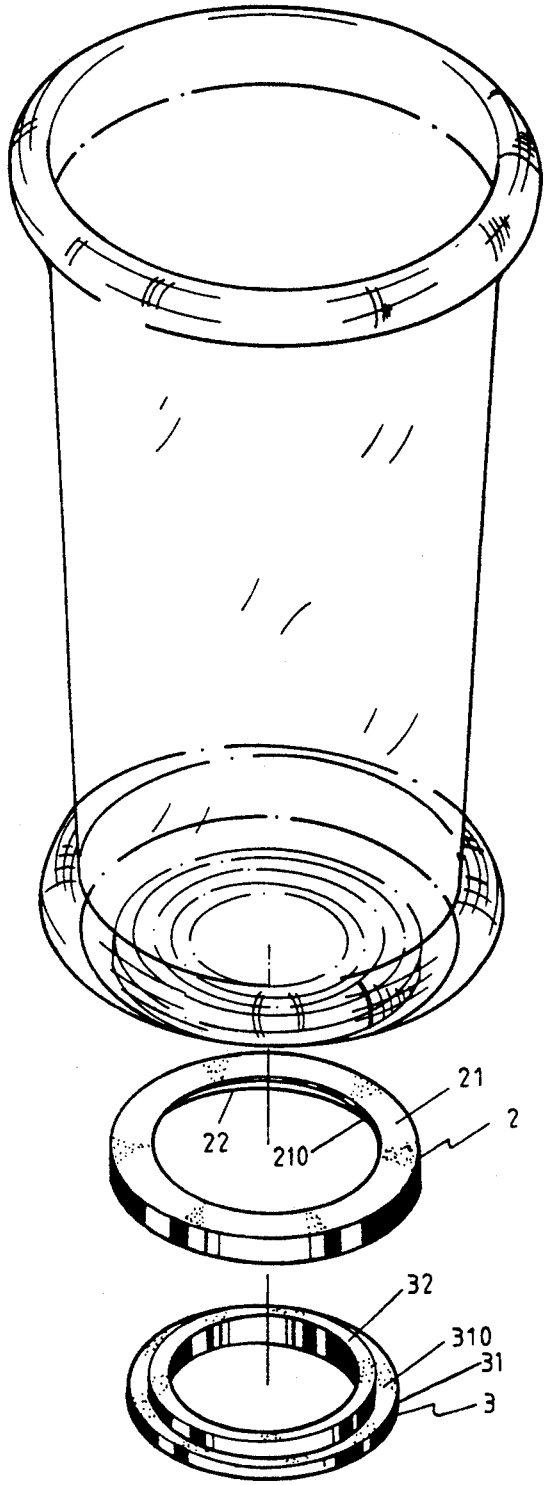
FIG. 9 is an exploded perspective view of a cup with the anti-slip structure in accordance with the present invention.

A cup with the anti-slip structure in accordance with the present invention, as shown in FIGS. 7, 8 and 9, comprises an annular groove 11 of L-shaped cross-section in the cup bottom wall 1, and the groove 11 has a small-sized annular vertical portion 111 and a large-sized annular horizontal portion 112. The anti-slip structure also has an outer annular anti-slip band 2 of reverse and inverted L-shaped cross-section made of elastic material and an inner fixing ring 3 of L-shaped cross-section to fit together in the groove 11 in the cup bottom wall 1.

The outer annular anti-slip band 2 has a horizontal portion 21 and a vertical portion 22. The width d1 of the horizontal portion 21 is a bit longer than the horizontal width d2 of the groove 11 so that the soft outer anti-slip band 2 can be pushed to fit elastically and securely in the groove 11. The vertical portion 22 is dimensioned to extend a bit out of the bottom wall 1 after the outer anti-slip band 2 is inserted in the groove 11, then the top surface 220 of the vertical portion 22 can sit on a surface where the cup is to be put on.

The inner fixing ring 3 is to be fitted in the inner portion of the groove 11 beside the outer anti-slip band 2, having a horizontal portion 31 and a vertical portion 32. After the inner fixing ring 3 is fitted in the groove 11 beside the outer anti-slip band 2, the outer surface of the horizontal portion 31 is on the same level as the cup bottom surface and the outer surface of the horizontal portion 31 is kept in touch with the inner surface of the vertical portion 22. So the depth of the vertical portion 32 is the same as the inner depth of the groove 11. The inner ring 3 is made of the same material as the cup, but the outer annular anti-slip band 2 should be made of a little elastic material.

When both the outer band 2 and the inner ring 3 has been fitted in the annular groove 11 in the cup bottom wall, the upper surface 310 of the inner ring 3 can be kept in touch with the bottom surface 210 of the outer anti-slip band 2 and thus both the anti-slip band 2 and the fixing ring 3 can be securely kept in the annular groove 11, not easily falling out of it, but their assemblage is quite simple.

The anit-slip structure for cups in the present invention and the three kinds of conventional anti-slip cups mentioned above has been compared to get the fact as follows.

The first kind of conventional cups needs super-sonic process to place securely the annular washer A1 in the annular groove A0 after the three curved ribs A20 of the anti-slip ring A2 is fitted in the fitting grooves A10 in the washer A1 to extend down the cup bottom surface. So it takes much more time in assemblage than that in the present invention, which needs only manual work in fitting both the anti-slip band 2 and the fixing ring 3 in the bottom groove 11.

The second kind of conventional cups simply uses the anti-slip band B1 to be fitted in the cup bottom groove B01. The third kind of conventional cups uses the anti-slip band C0 fitted around the projectiong disc C10. Evidently, their anti-slip structures are different from that in the present invention.

What is claimed is:

1. An anti-slip structure for cups comprising;

an annular groove of L-shaped cross-section in the cup bottom wall, having a horizontal portion and a vertical portion for an outer annular anti-slip band and an inner fixing ring to fit therein;

said annular anti-slip band being of reverse and inverted L-shaped cross-section and made of a soft elastic material to be fitted in the horizontal portion of the annular groove in the cup bottom wall, having a horizontal portion and a vertical portion, said vertical portion extending a little down the cup bottom surface;

an inner fixing ring of L-shaped cross-section made of a hard material to be fitted in the vertical and horizontal portions of the annular groove in the cup bottom wall, having a horizontal portion and a vertical portion; and said outer annular anti-slip band being first fitted in said horizontal portion of said annular groove, then said inner fixing ring being fitted in said vertical portion of said annular groove just beside the outer horizontal portion of the anti-slip band to have the upper surface of its horizontal portion kept in touch with the bottom surface of the horizontal portion of said outer anti-slip band so that said outer anti-slip band can be easily and quickly assembled with the cup to equip it with an anti-slip function.

* * * * *